US008864284B2

(12) United States Patent
Roth et al.

(10) Patent No.: US 8,864,284 B2
(45) Date of Patent: Oct. 21, 2014

(54) CAPPING FOR INKJET PRINTERS

(75) Inventors: Teressa L. Roth, Brush Prairie, WA (US); Mark L. Salzer, Vancouver, WA (US); Jeffrey N. Daley, Camas, WA (US); Dan Mayers, Milwaukie, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/695,103

(22) PCT Filed: Apr. 30, 2010

(86) PCT No.: PCT/US2010/033104

§ 371 (c)(1), (2), (4) Date: Jan. 4, 2013

(87) PCT Pub. No.: WO2011/136788

PCT Pub. Date: Nov. 3, 2011

(65) Prior Publication Data

US 2013/0106948 A1 May 2, 2013

(51) Int. Cl.
*B41J 2/165* (2006.01)

(52) U.S. Cl.
CPC ..... *B41J 2/16505* (2013.01); *B41J 2/16526* (2013.01); *B41J 2/16508* (2013.01)
USPC ..... 347/29; 347/32

(58) Field of Classification Search
USPC ..... 347/29, 30
See application file for complete search history.

(56) References Cited

U.S. PATENT DOCUMENTS

| | | | | |
|---|---|---|---|---|
| 5,448,270 | A | 9/1995 | Osborne | |
| 5,682,186 | A * | 10/1997 | Bohorquez et al. | 347/29 |
| 5,757,397 | A * | 5/1998 | Hirano et al. | 347/30 |
| 5,867,184 | A | 2/1999 | Quintana | |
| 6,068,364 | A | 5/2000 | Kusumi et al. | |
| 6,074,037 | A | 6/2000 | Nakahara et al. | |
| 6,081,282 | A | 6/2000 | Saijo | |
| 6,203,136 | B1 | 3/2001 | Takahashi et al. | |
| 6,209,983 | B1 | 4/2001 | Osborne et al. | |
| 6,220,689 | B1 | 4/2001 | Sturgeon | |
| 6,406,123 | B1 | 6/2002 | Usui et al. | |
| 6,491,369 | B1 | 12/2002 | Satoh et al. | |
| 6,773,088 | B2 | 8/2004 | Aldrich et al. | |
| 6,817,695 | B1 * | 11/2004 | Aldrich et al. | 347/29 |
| 7,021,741 | B2 | 4/2006 | Aldrich et al. | |
| 7,585,048 | B2 | 9/2009 | Nakashima | |

(Continued)

FOREIGN PATENT DOCUMENTS

| | | | |
|---|---|---|---|
| CN | 1706647 | A | 12/2005 |
| CN | 1803456 | A | 7/2006 |

(Continued)

OTHER PUBLICATIONS

International Search Report and Written Opinion received in related PCT Application No. PCT/US2010/033104, mailed Feb. 7, 2011, 9 pages.

*Primary Examiner* — Shelby Fidler

(57) ABSTRACT

A device for an inkjet printer includes a compliant cap, which in turn includes a floor and flexible walls extending upwardly from the floor, and a lip formed on the walls. The floor, walls and lip define an open interior volume sized to accommodate a print head assembly of the inkjet printer. The device further includes a cap post that accommodates the compliant cap and supports the floor.

15 Claims, 10 Drawing Sheets

(56) References Cited

U.S. PATENT DOCUMENTS

| | | | | |
|---|---|---|---|---|
| 2001/0012027 | A1* | 8/2001 | Murcia et al. | 347/29 |
| 2003/0227505 | A1* | 12/2003 | Tanaka et al. | 347/29 |
| 2004/0189738 | A1* | 9/2004 | Nakashima | 347/29 |
| 2005/0041058 | A1* | 2/2005 | Hayashi | 347/29 |
| 2008/0088666 | A1* | 4/2008 | Shindo et al. | 347/30 |
| 2010/0302308 | A1* | 12/2010 | Matsuura | 347/30 |

FOREIGN PATENT DOCUMENTS

| | | | |
|---|---|---|---|
| CN | 101121321 | A | 2/2008 |
| EP | 1 516 733 | A1 | 3/2005 |
| JP | 07195702 | | 8/1995 |
| JP | 2002- 72794 | | 6/2002 |
| JP | 2004-136512 | | 5/2004 |
| JP | 2008094040 | | 4/2008 |

* cited by examiner

CAPPING FOR INKJET PRINTERS

BACKGROUND

Inkjet printers typically use one or more print head assemblies that include an ink supply and means for directing fine droplets of ink through an interface on to a print medium. These print head assemblies can experience problems with respect to the desired application of the ink, including accumulation and drying out of the ink at the interface. The typical interface is an orifice plate having hundreds of orifices through which the ink flows. To solve or at least minimize the ink accumulation and drying problem, the print head assemblies may be housed, or docked, in a "cap" when the inkjet printer is not printing. The cap is intended to create a humid environment in which the interface is kept free of dried-out ink. Cap design then becomes an important element in the overall design of an inkjet printer.

DESCRIPTION OF THE DRAWINGS

The Detailed Description will refer to the following drawings, in which like numbers refer to like objects, and in which.

DETAILED DESCRIPTION

Figure 1A:
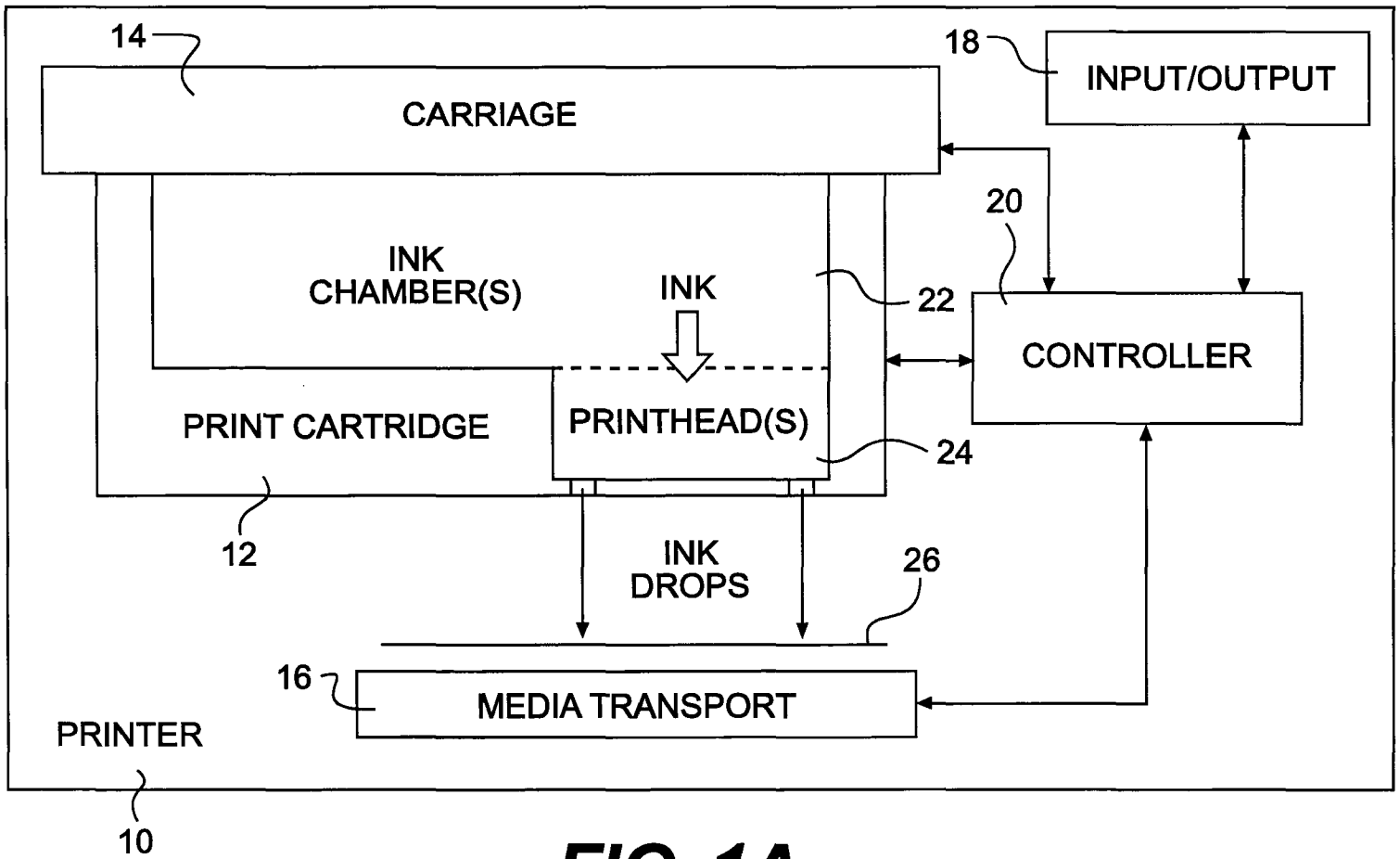
FIG. 1A illustrates, in block diagram form, an embodiment of an inkjet printer in which the disclosed low force capping may be implemented.

Inkjet printers use one or more print head assemblies that include an ink supply and means for directing fine droplets of ink on to a print medium (e.g., paper). The means for directing the ink on to the print medium includes an orifice plate having hundreds of very small orifices. This arrangement of the print head assemblies can cause problems to occur with respect to the desired application of the ink, including drying out of the ink at the orifice plate area. To solve or at least minimize the drying problem, the print head assemblies may be housed, or docked, in a "cap" when the inkjet printer is not printing. The cap is intended to sufficiently seal the cap to create a humid environment in which the orifice plate area is kept free of dried-out ink. Cap design then becomes an important element in the overall design of an inkjet printer. To provide a desired seal by the cap, some amount of force may be applied to the cap so as to conform it to the topology of the orifice plate area. The desired seal may require a large force, which can be created, for example, by a combination of springs and driving motors to be applied to the cap.

An improvement in cap design over that in previous inkjet printers is disclosed, with the improved cap design resulting in low force capping and thereby permitting construction of a less expensive inkjet printer. The improved cap design may include use of highly compliant materials to form the cap, means to control deformation of cap elements, and means to position the cap with respect to the orifice plate areas. The improved cap design establishes a humid environment that keeps corresponding print head assemblies in an optimum condition, even during long periods of inactivity. The improved cap design permits an inkjet printer to use lower power motors and circuits, and smaller springs or even no springs, to cap the print head assemblies. This reduction in spring size or elimination of springs altogether, can result in a smaller vertical dimension of the overall inkjet printer.

An improved cap may be used as a component of a low-force capping system. The low-force capping system includes, in addition to the cap, components that retain and locate the cap, an engagement mechanism that causes the cap to engage the orifice plate area of a print head assembly, and a driving mechanism (motor) that provides power to seal the orifice plate area.

An embodiment of an inkjet printer using a low-force capping system contains two print head assemblies: one for black-ink, and one for color-ink printing. Each print head assembly includes an orifice plate in which are formed hundreds of orifices through which ink is injected onto a print medium. The print head assemblies are carried in a carriage that may translate along the +X/−X axis to inject ink onto the print medium, with the print medium advancing along the +Y/−Y axis. When not in use (i.e., when the inkjet printer is not executing any print commands), the print head assemblies, and primarily the orifice plate areas, are placed "in cap." In an embodiment, each cap is carried on a cap post, and the cap posts are carried on a cap sled. In this embodiment, the cap posts are able to move in the +Z/−Z directions relative to the cap sled. In another embodiment, a movable cap post in not used, and any +Z/−Z movement relative to the cap sled is accommodated by the cap only.

FIG. 1A shows, in block diagram form, an embodiment of an inkjet printer in which disclosed low force capping embodiments of a wiper may be implemented. In FIG. 1A, inkjet printer 10 includes a print cartridge 12, a carriage 14, a print media transport mechanism 16, an input/output device 18, and a printer controller 20 connected to each of the operative components of printer 10. Print cartridge 12 includes one or more ink holding chambers 22 and one or more print head assemblies 24. A print cartridge is sometimes also referred to as an ink pen or an ink cartridge. Print head assembly 24 represents generally a small electromechanical part that contains an array of miniature thermal resistors or piezoelectric devices that are energized to eject small droplets of ink out of an associated array of orifices. A typical thermal inkjet print head assembly, for example, includes an orifice plate arrayed with ink ejection orifices and firing resistors formed on an integrated circuit chip. Each print head assembly is electrically connected to the printer controller 20 through external electrical contacts. In operation, the printer controller 20 selectively energizes the firing resistors through the electrical contacts to eject a drop of ink through an orifice on to the print media 26.

Print cartridge 12 may include a series of stationary cartridges or print head assemblies that span the width of the print media 26. Alternatively, the cartridge 12 may include one or more cartridges that scan back and forth on the carriage 14 across the width of the print media 26. Other cartridge or print head assembly configurations are possible. A movable carriage 14 may include a holder for the print cartridge 12, a guide along which the holder moves, a drive motor, and a belt and pulley system that moves the holder along the guide. Media transport 16 advances the print media 26 lengthwise past the print cartridge 12 and the print head assembly 24. For a stationary cartridge 12, the media transport 16 may advance the print media 26 continuously past the print head assembly 24. For a scanning cartridge 12, the media transport 16 may advance the print media 26 incrementally past the print head assembly 24, stopping as each swath is printed and then advancing the print media 26 for printing the next swath. Controller 20 may communicate with external devices through the input/output device 18, including receiving print jobs from a computer or other host device. Controller 20 controls the movement of the carriage 14 and the media transport 16. By coordinating the relative position of the print cartridge 12 and the print head assembly 24 with the print media 26 and the ejection of ink drops, the controller 20 produces the desired image on the print media 26.

Specific components of an embodiment for improved low-force capping of a print head assembly orifice plate in an inkjet printer include a compliant cap having a floor and flexible walls extending upwardly from the floor. In one specific embodiment, the compliant cap may include a curved lip portion extending upwardly and outwardly from the walls. The floor, walls, and curved lip portion define an open interior volume sized to accommodate the orifice plate. The improved low-force capping components also include a cap sled for carrying the compliant cap, means for coupling the compliant cap to the cap sled, and means for applying a compressive force to the compliant cap. In this system, the walls and curved lip portion deform to create a sealed environment in the open interior volume.

In one embodiment of this system, the floor has formed therein one or more location holes and the means for coupling the compliant cap to the cap sled includes a cap clip having clip location elements for insertion through the one or more location holes. A cap post accommodates the compliant cap and has recesses for insertion of the location elements so as to locate and secure the compliant cap to the cap post, with the cap post supporting the floor. In this embodiment, the cap post includes a spring post that accommodates a spring, the spring coupling the cap post to the cap sled and resisting downward forces on the compliant cap and cap post, and location prongs to locate the cap post in the cap sled in an X-Y plane. The cap sled has formed therein location receptacles to accommodate the location prongs and to limit travel of the cap post. The combination of the spring, the location prongs, and the location receptacles allow a gimballing motion of the cap post.

In another low force capping embodiment, the cap sled has formed thereon a compliant cap location tab, and the means for coupling the compliant cap to the cap sled includes a flexible compression member extending downwardly from the floor and having formed therein a slot that accommodates the compliant cap location tab. In addition, the floor is not supported by a cap post and so is free to flex. During capping, the compression member applies an upward force that causes flexion of the floor, the flexion causing deformation of the walls and curved lip portion to seal the print head assembly. In addition, because the compression member is flexible, this embodiment of the compliant cap can gimbal about a center point of the compression member.

Figure 1B:
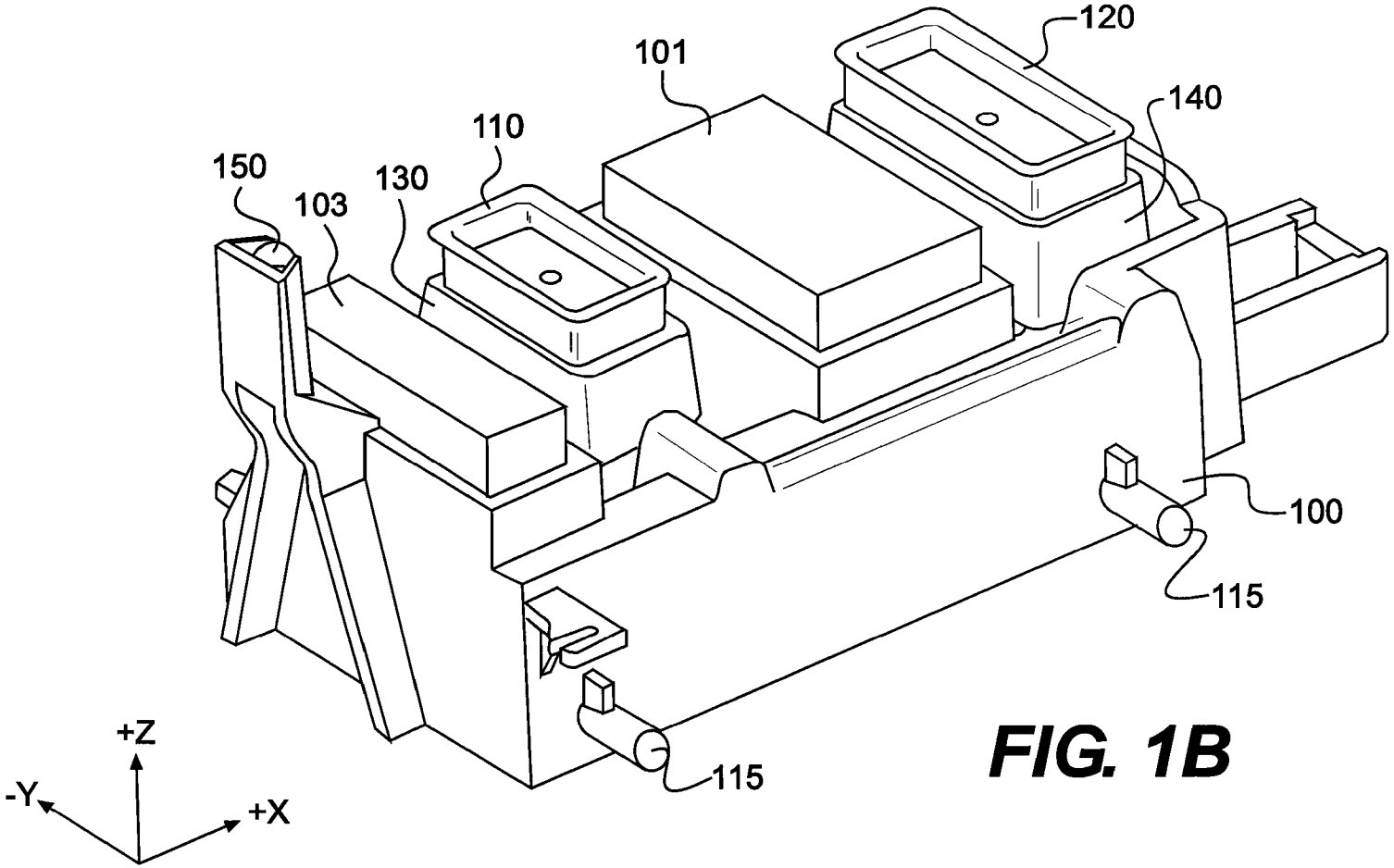
FIG. 1B illustrates an embodiment of a cap sled that employs example embodiment caps for capping print head assemblies.

FIG. 1B illustrates an embodiment of a structure that employs low force capping of print head assemblies of an inkjet printer. In FIG. 1B, an inkjet printer (see FIG. 1A) uses an embodiment of a cap sled, which may be a molded plastic structure, to cap the print head assemblies. In an embodiment, cap sled 100 is molded from an ABS plastic reinforced with about 20 percent glass fibers. The cap sled 100 primarily moves along the +X/−X axis, and to a more limited degree, along the +Z/−Z axis, using, in an embodiment, a ramp (not shown) so that when capping of print head assemblies is desired, the entire cap sled 100 moves up the ramp (i.e., in the +Z-direction). Caps 110 and 120 are pressed against their respective print head assemblies, deform, and thus create a desired humid environment around the print head assembly orifice plate areas.

In an alternative embodiment, instead of a ramp, a planar linkage mechanism may be used. A specific example of a planar linkage mechanism is a four-bar linkage mechanism. Such a four-bar linkage mechanism can translate X-direction motion of the cap sled into Z-direction motion without rotation of the cap sled. When a four-bar linkage mechanism is used, the mechanism is coupled to the cap sled 100 by support pins 115 (two of four shown in FIG. 1B). Other mechanisms may be used to translate X-direction motion into Z-direction motion of the cap sled 100.

The caps 110 and 120 are carried by cap posts 130 and 140, respectively. The cap posts 130 and 140 are permitted some movement along the +Z/−Z axis relative to the cap sled 100, as will be described later, but movement in the X or Y directions relative to the cap sled 100 generally is constrained to that permitted by manufacturing and installation tolerances and gimballing action, as will be apparent from FIGS. 2-4 and their accompanying description. In an embodiment, springs 170 (see FIG. 6) connecting undersides of the cap posts 130 and 140 to the cap sled 100, create a spring force that pushes up (+Z-direction) on the cap posts 130 and 140.

Adjacent to the cap posts 130 and 140 are, respectively, blotters 103 and 101.

The caps 110 and 120 differ primarily in their size. In an embodiment, the smaller cap 110 is used with a color-ink print head assembly and the larger cap 120 is used with a black-ink print head assembly.

To provide the desired +X/−X movement of the cap sled 100, a carriage assembly (not shown) that houses the print head assemblies contacts the cap sled 100 by way of cap sled pin 150. As the carriage assembly pushes against the pin 150, the cap sled 100, in an embodiment, is driven up a short, shallow ramp to create +Z-direction travel of the caps 110/120. Once driven completely up the ramp, the cap sled 100 is in its capping position, and the caps 110 and 120 are pressed against their respective print heads so as to prevent or limit ink dry out. As noted above, other mechanisms may be used to translate X-direction motion of the cap sled into Z-direction motion.

Figure 3:
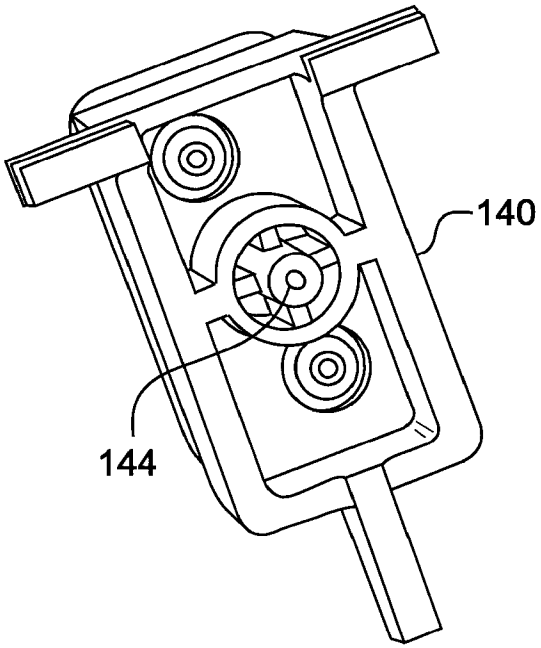
FIGS. 2-4 are views of embodiments of a cap and a cap post used with the cap sled of FIG. 1B.
Figure 2:
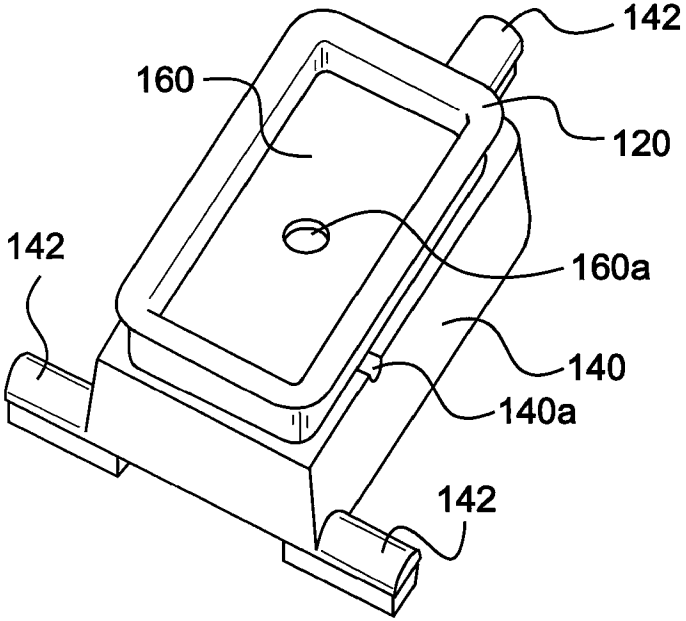
Figure 4:
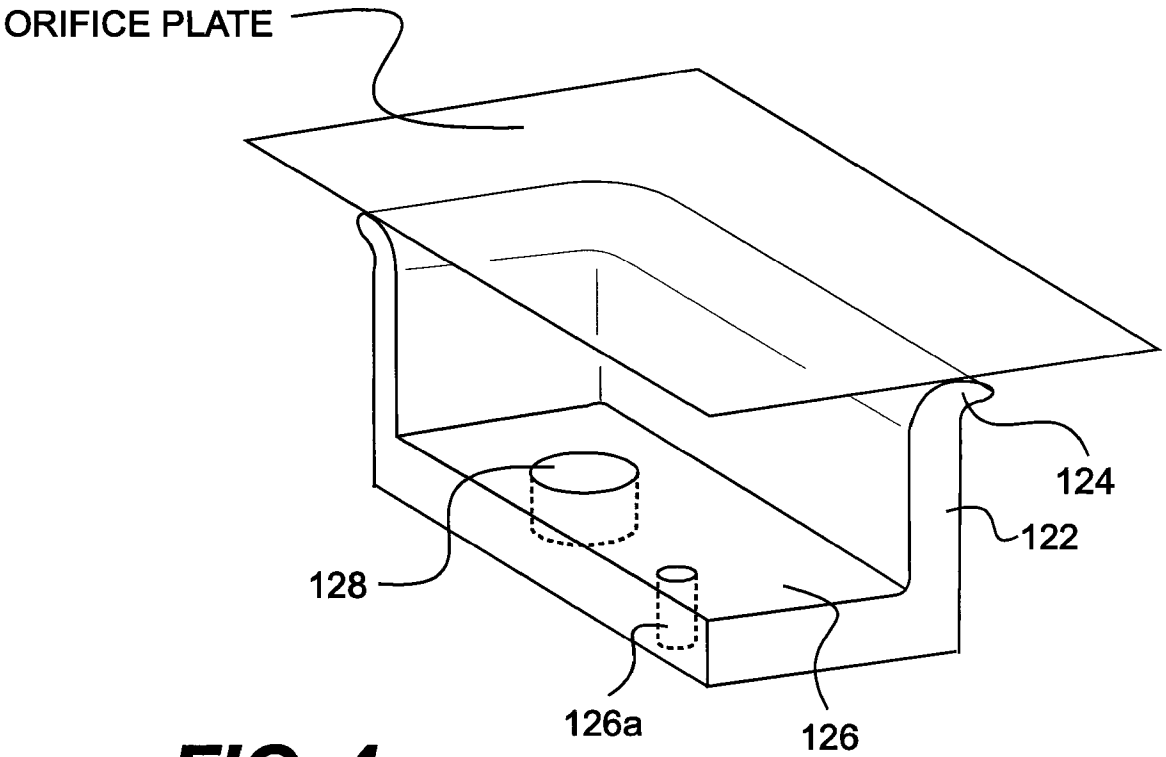

FIGS. 2-4 are views of embodiments of a cap and a cap post used with the cap sled 100 of FIG. 1B. FIG. 2 is a top perspective view of cap 120 being carried by cap post 140. Cap post 140 includes three protrusions or location prongs 142 that mate with location receptacles (not shown) of the cap sled to locate the cap post 140 within the cap sled 100 and that limit cap post travel.

Also shown in FIG. 2 is cap clip 160. Vent hole 160*a* is located in the cap clip 160. Vent terminus 140*a* connects to the vent hole 160*a* and a corresponding vent hole in the cap 120 to relieve pressure spikes that might occur when a print head assembly is capped. The cap clip 160 will be described in detail with respect to FIGS. 5 and 6.

FIG. 3 is a bottom perspective view of the cap post 140. Cap post 140 is shown with spring post 144 extending downwardly at a center of the cap post 140. The spring post 144 is used to position the spring 170 that acts on the cap sled 140 in the +Z direction. Located in cap post 140 is a labyrinth vent path (not shown) that connects the vent hole 160*a* and the vent terminus 140*a*.

The combination of the centrally-located engagement spring 170 and the location prongs 142 means that the cap post 140 is, to a limited degree, able to gimbal about the spring post 144. Ideally, a plane defined by the top-most extreme of the caps 110/120 would be co-planar with a plane defined by the orifice plate areas when the print head assemblies are uncapped. However, this gimballing affect can be used to accommodate slight (non-planar) mis-alignments between the orifice plate areas and the caps 110/120. The gimballing movement may induce some X or Y displacement of the cap post relative to the cap sled 100.

FIG. 4 is a cutaway top perspective view of exemplary cap 120. Cap 110 is similar except for its size. The cap 120 includes thin, highly compliant walls 122 terminating in curled lip surface 124 and floor 126. The floor 126 includes location holes 128 (one of two shown) that, as will be explained later, are used to locate the cap 120 to the cap post 140. The floor 126 also includes vent hole 126*a*. The entire cap 120 is molded out of an elastomer material such as EPDM, for example. The thin, highly compliant walls 122 serve as beams that can buckle under pressure. The curled lip surface 124 enables the cap 120, when pressed against an uneven surface such as that of a print head assembly, to form a seal—the curled lip surface 124 conforming to the uneven topology of the orifice plate area. More specifically, as the curled lip surface 124 is brought into contact with the orifice plate area by the force created by the upward travel of the cap sled 100 and corresponding compression of cap post spring 170, the curled lip surface 124 is able to comply with the various features of the orifice plate area. As more force is applied in the −Z-direction through +Z-direction travel of the cap sled 100, the walls 122 buckle to provide more compliance so that an adequate seal is formed to create the desired humid environment which consequently ensures the orifices are not clogged with dried ink.

Figure 5:
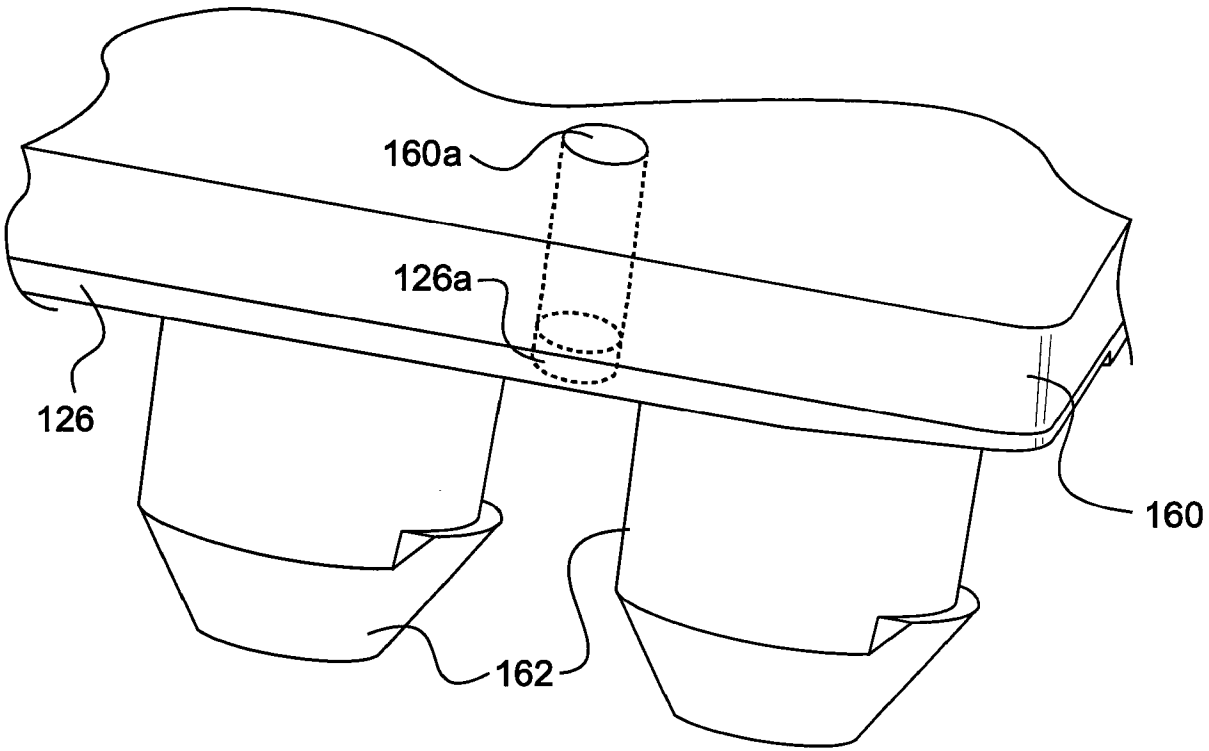
FIG. 5 is a perspective view of an embodiment of a cap clip used with the cap and cap post of FIGS. 2-4.

To maintain the as-molded shape of the cap 120 and to only comply with the topology of the print head assembly orifice plate area, a cap clip, an embodiment of which is shown a partial cutaway perspective view in FIG. 5, is used to fix the cap 120 to the cap post 140. That is, in an embodiment, the cap 120 is molded as a monolithic element so that the floor 126 would be subject to deformation if not supported by and fixed to the cap post 140. Referring to FIGS. 4 and 5, cap clip 160 is shown to have the approximate shape of the floor 126 of the cap 120. The cap clip 160 also includes protruding clip location elements 162 that pass through the location holes 128 and engage corresponding holes (not shown) in the cap post 140 to provide for location and retention of the cap 120 on the cap post 140. When the cap 120 is assembled to the cap post 140, the cap post 140 allows spring force (spring 170) to push upwardly on the cap 120 without distortion of the floor 126, thereby ensuring that any distortion of the cap 120 when engaging the print head assembly orifice plate area is through the walls 122 and curled lip surface 124.

Figure 6:
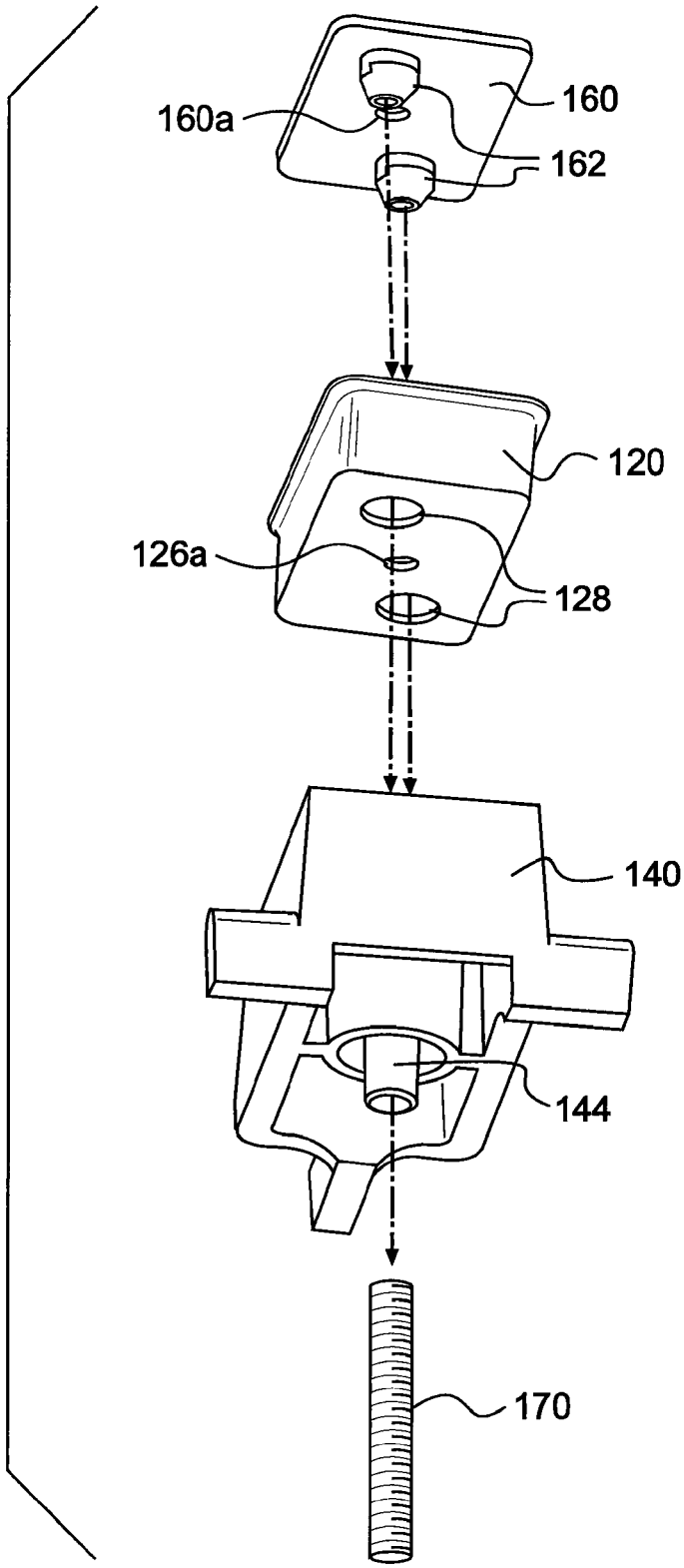
FIG. 6 is an exploded view of embodiments of a spring, cap post, cap, and cap clip.

FIG. 6 is an exploded view of embodiments of the cap post 140, cap 120, and cap clip 160, as well as engagement spring 170. As can be seen from FIG. 6, cap clip 160 is assembled into the cap 120 with the protruding clip elements 162 passing through location holes 128 to engage the cap post 140 and secure the cap 120 to the cap post 140. The spring 170 slides over the spring post 144. As also can be seen in FIG. 6, vent holes 160*a* and 126*a* are aligned, and cooperate with the cap post vent path (not shown), which ends with vent terminus 140*a* (see FIG. 2) to prevent pressure spikes in the cap volume.

As can be appreciated from FIGS. 2-6, one means for coupling the compliant cap 120 to the cap sled 100 includes cap clip 160 having location prongs 162 for insertion through the one or more location holes. The cap clip 160 fixes the cap 120 to the cap post 140, and the cap post 140 supports the floor 126 of the compliant cap 120. The cap post 140 includes a spring post 144 that accommodates a spring 170. The spring 170 couples the cap post 140 to the cap sled 100 and resists downward forces on the compliant cap 120 and cap post 140. The cap post 140 also includes location prongs 142 to locate the cap post 140 in the cap sled 100 in an X-Y plane, and the cap sled includes receptacles to accommodate the prongs 142 and to limit travel of the cap post 140, The spring, location prongs, and receptacles cooperate to allow a gimballing motion of the cap post 140.

Figure 7A:
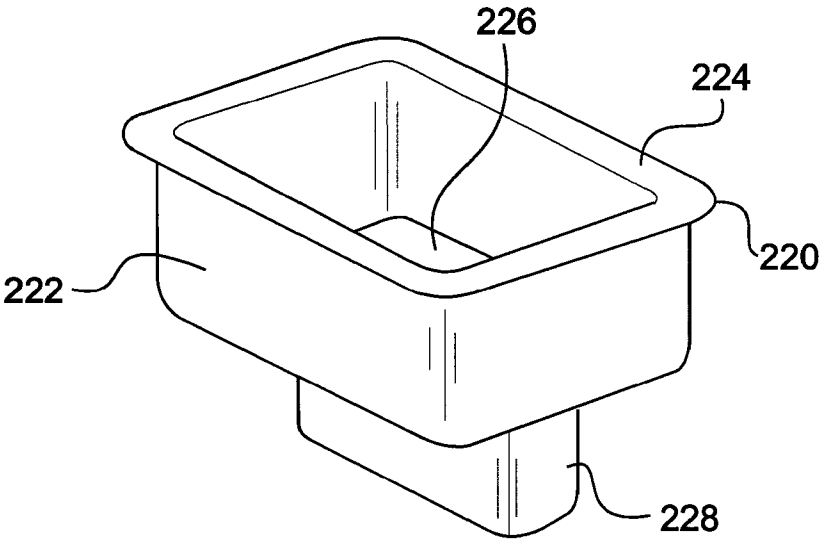
FIG. 7A is a perspective view of an alternative embodiment of a cap.
Figure 7B:
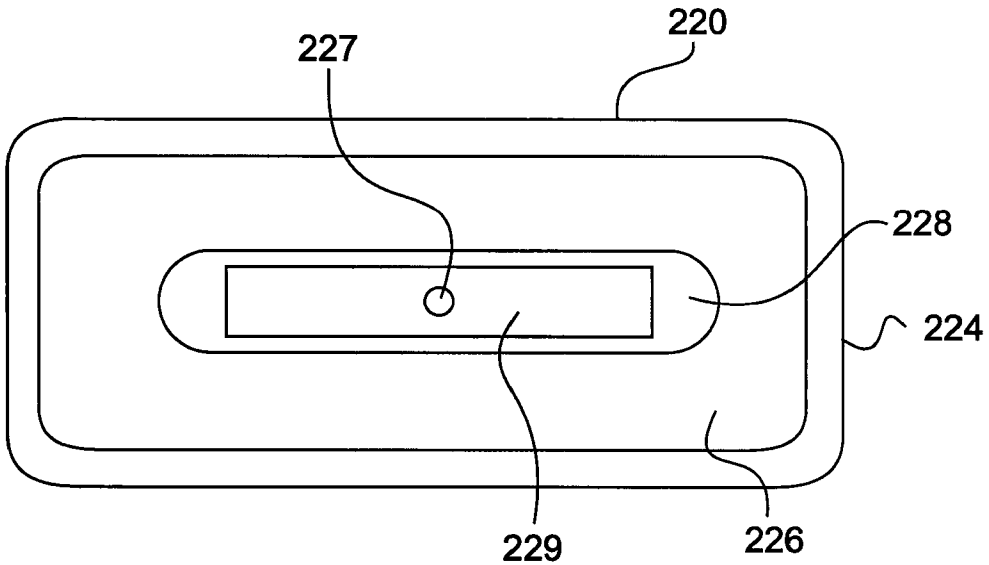
FIG. 7B is a bottom view of the alternative cap embodiment of FIG. 7A.
Figure 7C:
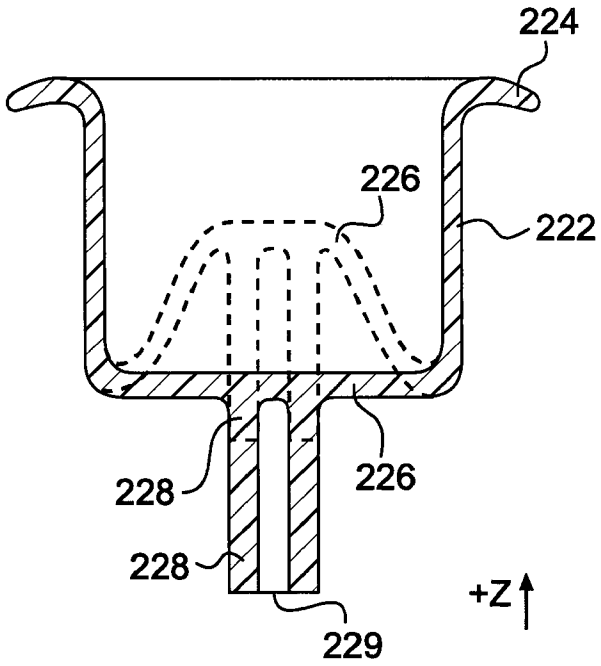
FIG. 7C is a simplified cutaway view of the alternative cap embodiment of FIG. 7A when a compressive force is applied.
Figure 8:
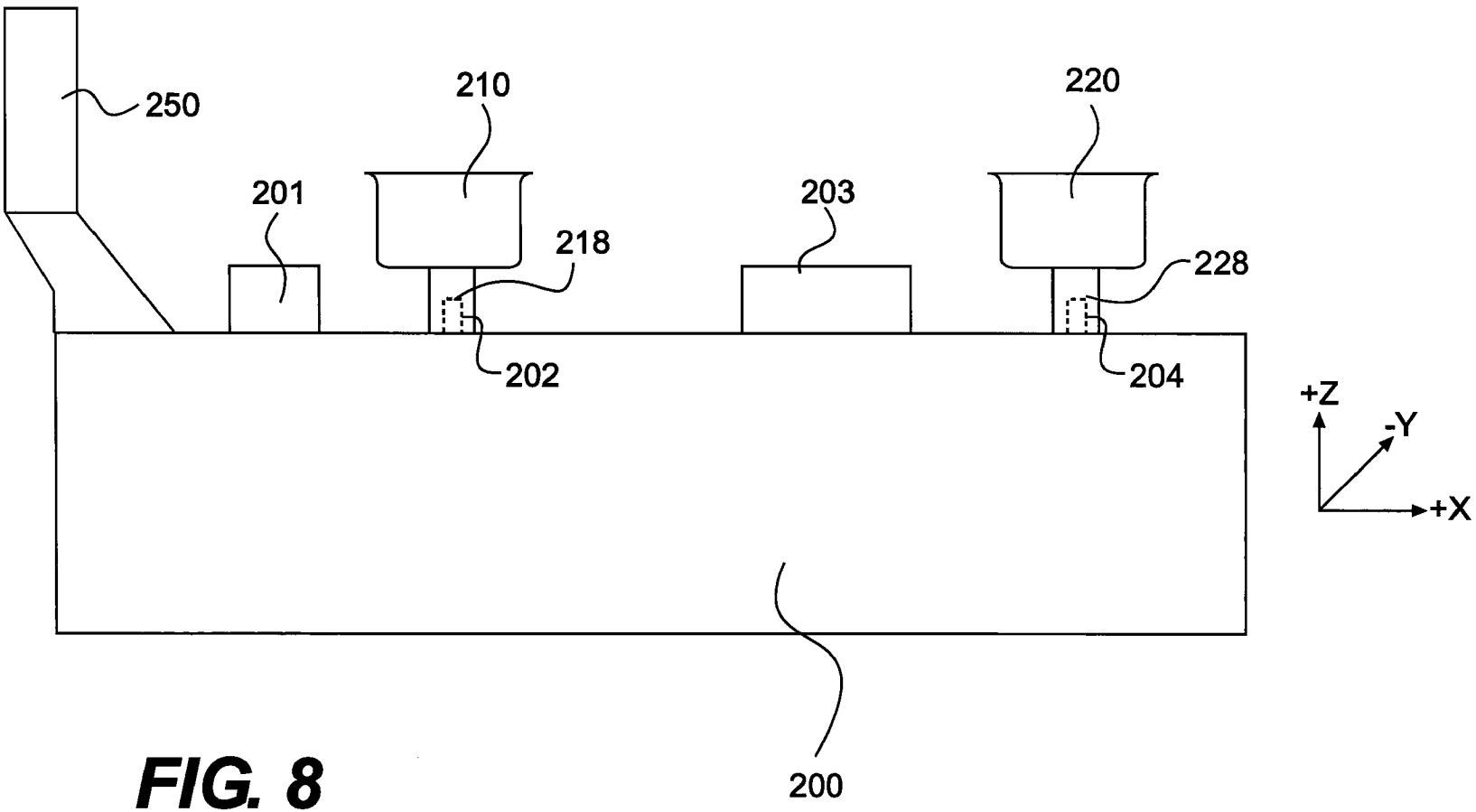
FIG. 8 illustrates an embodiment of a cap sled that accommodates the alternative cap embodiment of FIG. 7A.

FIGS. 7A-8 describe an alternate means for coupling a compliant cap to a cap sled. The alternate means includes a flexible compression member extending downwardly from a flexible floor. The compression member includes a slot that accommodates a corresponding compliant cap location tab formed on the cap sled. In a capping operation, the compression member applies an upward force that causes flexion of the floor, the flexion causing deformation of the walls and a curved element, thereby creating a desired humid environment.

FIG. 7A is a perspective view of an alternative cap embodiment. In FIG. 7A, cap 220 includes thin, highly compliant walls 222, at the top of which may, in an embodiment, be formed curved element 224, and flexible cap floor 226. However, instead of being placed on a spring-loaded cap post, the cap 220 is placed over a fixed tab (see FIG. 8) in an alternate cap sled by way of location and compression member 228.

FIG. 7B is a bottom view of the alternative exemplary cap 220 of FIG. 7A showing the flexible compression member 228 in more detail. As can be seen, the flexible compression member 228 includes rectangular slot 229 that forms a tight fit with the fixed tab to locate and hold the cap 220 in the cap sled. Vent hole 227 is formed in the floor 226 to relieve pressure spikes in the cap 220.

The cap 220 does not use springs to resist the downward force applied to the cap 220 when the cap sled moves to the capping location. Instead, the flexible floor 226 of the cap 220 deforms to transmit a force through the walls 222 and thus create a desired seal. FIG. 7C is a simplified cutaway view of the cap of FIG. 7A when a compressive force is applied. Although the compression member 228 is flexible, it is stiffer that the flexible floor 226. Thus, when the flexible compression member 228 presses against it, the flexible floor 226 deforms to the position shown in dashed line, creating an upward force that in turn is transmitted through the thin, highly compliant walls 222 to deform the walls 222 and thereby create the desired seal.

FIG. 8 shows a cap sled embodiment that accommodates the cap 220 (and a second cap 210, which is similar to the cap 220). As can be seen, the cap 220 is attached to cap sled 200 using flexible compression member 228 and a cap location tab 204 (shown in dashed line in FIG. 8) formed on the cap sled 200. The cap 210 similarly is attached to the cap sled 200 using compression member 218 and tab 202. Because the compression member 228 is flexible, the cap 220 may gimbal in a manner similar to that of the cap post 140 so as to accommodate non co-planar orientation of the cap 220 relative to the orifice plate area.

To provide the desired +X/−X movement of the cap sled 200, a carriage assembly (not shown) that houses the print head assemblies contacts the cap sled 200 by way of cap sled pin 250. As the carriage assembly pushes against the pin 250, the cap sled 200 is driven in the −X direction. This −X-direction movement is then translated into some +Z-direction travel by, for example a ramp. Once the +Z-direction travel is completed, the cap sled 200 is in its capping position, and the caps 210 and 220 are pressed against their respective print heads so as to seal the print head assembly orifice plate areas from the outside environment and limit any ink dry out problems.

The sealing ability of the caps 110/120 or the caps 210/220 potentially is affected by any mis-alignment of the cap with the orifice plate area. Such mis-alignment could occur in either the X- or the Y-directions. However, because of their compliance capacity and the gimballing motion of the corresponding cap post, the caps 110/120 can provide a desired seal with normally-encountered mis-alignment. Similarly, the compliance and gimballing feature of the caps 210/220 can accommodate normally-encountered mis-alignment.

We claim:

1. A device for an inkjet printer, comprising:

a compliant cap, comprising:

a floor, flexible walls extending vertically upward from the floor, and a curled lip extending outwardly from tops of the walls and forming a continuous shape, the floor, the walls, and the curled lip defining an open interior volume sized to accommodate an orifice plate area of a print head assembly of the inkjet printer, the flexible walls to buckle under a compressive force to seal the interior volume; and a cap post that supports the compliant cap.

2. The device of claim 1, further comprising:

a cap sled carrying the cap post, wherein the cap post further comprises a spring post accommodating a spring, the spring coupling the cap post to the cap sled and resisting downward forces on the compliant cap and the cap post; and a cap clip to secure the cap to the cap post such that the cap floor is sandwiched between the cap clip and the cap post.

3. The device of claim 2, wherein the cap post further comprises location prongs to locate the cap post in the cap sled in an X-Y plane.

4. The device of claim 3, wherein the cap sled comprises receptacles to accommodate the location prongs and to limit travel of the cap post, and the spring, the location prongs and the receptacles cooperate to enable a gimballing motion of the cap post.

5. The device of claim 3, wherein the cap sled comprises a cap pin, and further comprising a carriage motor to generate a lateral force to draw the cap sled into a capping position of the compliant cap.

6. The device of claim 5, further comprising an X-Z direction translation mechanism, wherein the cap sled is driven to a capping position to cause compression of the walls and the curled lip to create the sealed environment.

7. The device claim 1, wherein the compliant cap is a monolith.

8. A device for capping a print head in an inkjet printer, comprising:

a compliant cap, comprising:

a floor, flexible walls extending vertically upward from the floor, and a flexible curled lip section located at an extremity of the flexible walls, the floor, the walls, and the curled lip section defining a volume sized to accommodate the print head, the flexible walls to buckle under a compressive force to form a seal around the volume;

a cap post to accommodate and support the compliant cap; and a cap clip to locate the compliant cap on the cap post.

9. The device of claim 8, further comprising a cap sled carrying the cap post, the cap post comprises a spring post accommodating a spring, the spring coupling the cap post to the cap sled and resisting downward forces on the compliant cap and the cap post.

10. The device of claim 9, wherein the cap post further comprises location prongs to locate the cap post in the cap sled in an X-Y plane, the cap sled comprising receptacles to accommodate the location prongs and to limit travel of the cap post, and the spring, the location prongs, and the receptacles cooperating to allow a gimballing motion of the cap post.

11. The device of claim 8, further comprising a ventilation path to limit pressure spikes in the compliant cap, the compliant cap is molded as a monolithic element.

12. A device for capping a print head assembly in an inkjet printer, comprising:

a compliant cap, comprising:

a floor, and walls extending vertically upward from the floor and terminating in a curled lip portion extending outwardly from the walls and forming a continuous shape, the walls, the curled lip section, and the floor defining an open interior volume sized to accommodate the print head assembly;

a cap sled to carry the compliant cap; and means for coupling the compliant cap to the cap sled, the walls to buckle under a compressive force to create a sealed environment in the open interior volume.

13. The device of claim 12, wherein the floor comprises one or more location holes and the means for coupling the compliant cap to the cap sled, comprises:

a cap clip having location elements; and a cap post that accommodates the compliant cap and has recesses to receive the the location elements, the compliant cap being located on and secured to the cap post;

wherein the cap post further comprises:

a spring post that accommodates a spring, the spring coupling the cap post to the cap sled and resisting downward forces on the compliant cap and the cap post, location prongs to locate the cap post in the cap sled in an X-Y plane;

the cap sled comprising location receptacles to accommodate the location prongs and to limit travel of the cap post, the spring, the location prongs, and the location receptacles cooperating to allow a gimballing motion of the cap post.

14. The device of claim 12, wherein the floor is flexible, the cap sled comprises a compliant cap location tab, and the means for coupling the compliant cap to the cap sled, comprises:

a flexible compression member extending downwardly from the flexible floor, the flexible compression member comprising a slot to accommodate the compliant cap location tab, the flexible compression member to apply an upward force to cause flexing of the flexible floor, the flexing causing deformation of the walls to create the sealed environment, and the flexible compression member permits a gimballing motion of the compliant cap.

15. The device of claim 14, wherein the cap sled is molded from an ABS plastic reinforced with about 20 percent glass fibers, the compliant cap and compression element are molded as a monolithic element.

* * * * *

UNITED STATES PATENT AND TRADEMARK OFFICE

CERTIFICATE OF CORRECTION

PATENT NO. : 8,864,284 B2
APPLICATION NO. : 13/695103
DATED : October 21, 2014
INVENTOR(S) : Teressa L. Roth et al.

It is certified that error appears in the above-identified patent and that said Letters Patent is hereby corrected as shown below:

In the Claims

In column 7, line 66, in Claim 7, delete “device” and insert -- device of --, therefor.

In column 8, line 50, in Claim 13, delete “the the” and insert -- the --, therefor.

In column 8, line 56, in Claim 13, delete “post,” and insert -- post, and --, therefor.

Signed and Sealed this
Thirty-first Day of March, 2015

Michelle K. Lee

Michelle K. Lee
*Director of the United States Patent and Trademark Office*